United States Patent [19]

Bryant

[11] 3,970,893

[45] July 20, 1976

[54] APPARATUS FOR CONTROLLING THE INTENSITY OF LIGHTS

[75] Inventor: Doyle D. Bryant, Granada Hills, Calif.

[73] Assignee: Strand Century Incorporated, Elmwood Park, N.Y.

[22] Filed: Nov. 27, 1974

[21] Appl. No.: 527,922

[52] U.S. Cl. ..... 315/293; 315/291; 315/315; 307/228

[51] Int. Cl.[2] ..... H05B 41/38

[58] Field of Search ..... 315/291, 293, 312, 315, 315/316, 317, 318; 307/228

[56] References Cited

UNITED STATES PATENTS

| | | | |
|---|---|---|---|
| 3,521,124 | 7/1970 | Bogner | 315/318 |
| 3,579,030 | 5/1971 | Bentham | 315/291 |
| 3,668,467 | 6/1972 | Isaac | 315/316 |
| 3,706,914 | 12/1972 | Van Buren | 315/291 |
| 3,766,431 | 10/1973 | Isaacs | 315/316 |

*Primary Examiner*—John Kominski
*Attorney, Agent, or Firm*—Seidel, Gonda & Goldhammer

[57] ABSTRACT

A latching circuit is used to exclusively select either a full intensity command signal, a presettable intermediate intensity command signal or a zero intensity command signal. The command signals are fed to an output signal generating circuit which controls a variable voltage supply source for a lighting system. A null comparator and integrating circuit compares the output signal with the selected command signal and increases or decreases the output signal until it is in conformity with the selected command signal. Circuits are also disclosed which provide the capability of changing the intensity of the lights between two preselected intermediate intensity levels or between any two of a number of preselected intermediate intensity levels.

19 Claims, 7 Drawing Figures

APPARATUS FOR CONTROLLING THE INTENSITY OF LIGHTS

DISCLOSURE

This invention relates to an apparatus for controlling the intensity of lights and more particularly to an electronic circuit which automatically changes the intensity of lights in response to electrical command signals.

It is often desirable to lower the intensity of the lights in a room or a series of rooms in a building. It is also sometimes desirable to change the intensity of the lights from one intermediate level to a second intermediate level. For example, in a nightclub or restaurant, it is often desirable to have the lights at full intensity during the lunch and afternoon hours and at a lower intensity during the dinner hours. It is also often desirable to further lower the intensity of the lights during the performance of a nightclub act and to again increase the lighting intensity after the performance. In addition, during the presentation of a live play, or the like, it is often desirable to gradually change the intensity of the stage lights in order to dramatize the various moods of the play or to indicate the changing times of day.

For the most part, the intensity of lights has been controlled by manually operated rheostats or manually adjusted semiconductor dimmers. These manually controlled devices, however, suffer from several inherent defects all of which are caused by the fact that they must be controlled by hand. Accordingly, it is literally impossible to bring the intensity of the lights to the exact same level at several different times. Furthermore, it is even more difficult for a person controlling the lights to ensure that the rate of change of the intensity remains the same when this is important. Even further, it is often desired to have the intensity of the lights changing at a relatively slow rate such as over a period of several seconds or longer. Manually operated control means, would require an operator to stay at the control means and slowly turn the same over this entire period. Various mechanical means have been proposed in the past for slowing changing the intensity of lights between two predetermined levels. These prior art devices are composed for the most part of gear motors and a plurality of variable potentiometers. These prior art devices, however, have not proved to be completely satisfactory. While they may be useful for slowly changing the intensity of lights, they do so at a fixed number of discrete rates. Accordingly, they have limited application and cannot be used when it may be desired to change the rate at which the intensity of the lights are to be changed.

The present invention overcomes all of the above-mentioned defects of the prior art with the use of latching circuit which includes a plurality of manual push-buttons for exclusively selecting either a full intensity command signal, a presettable intermediate intensity command signal or a zero intensity command signal. The command signals are fed to an output signal generating circuit which is used to control a variable voltage supply source for the lighting system. A null comparator and integrating circuit compares the output signal with the selected command signal and increases or decreases the output signal until it is in conformity with the selected command signal. The integrating circuit ensures that the rate of change is linear and includes a variable resistor means which allows the rate of change to be adjusted.

A second embodiment of the present invention further provides means for fading between a first and a second preset intensity level by utilizing a voltage to pulse width converter circuit in conjunction with the above-mentioned null comparator and integrating circuit. More particularly, the intensity of the lights may be faded from a first to a second preset intensity level in a fade time determined by the rate of integration of the integrator circuit.

A third embodiment of the present invention provides yet greater control over the intensity of the lights by providing means for fading between any two of four preselected intensity levels. More particularly, the third embodiment of the present invention utilizes a four scene preselector circuit in conjunction with the voltage to pulse width converter circuit and null comparator and integrating circuit employed in the first two embodiments of the present invention to provide a means for fading the intensity of the light between any two of four preset intensity levels in a fade time determined by the rate of integration of the integrator circuit.

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
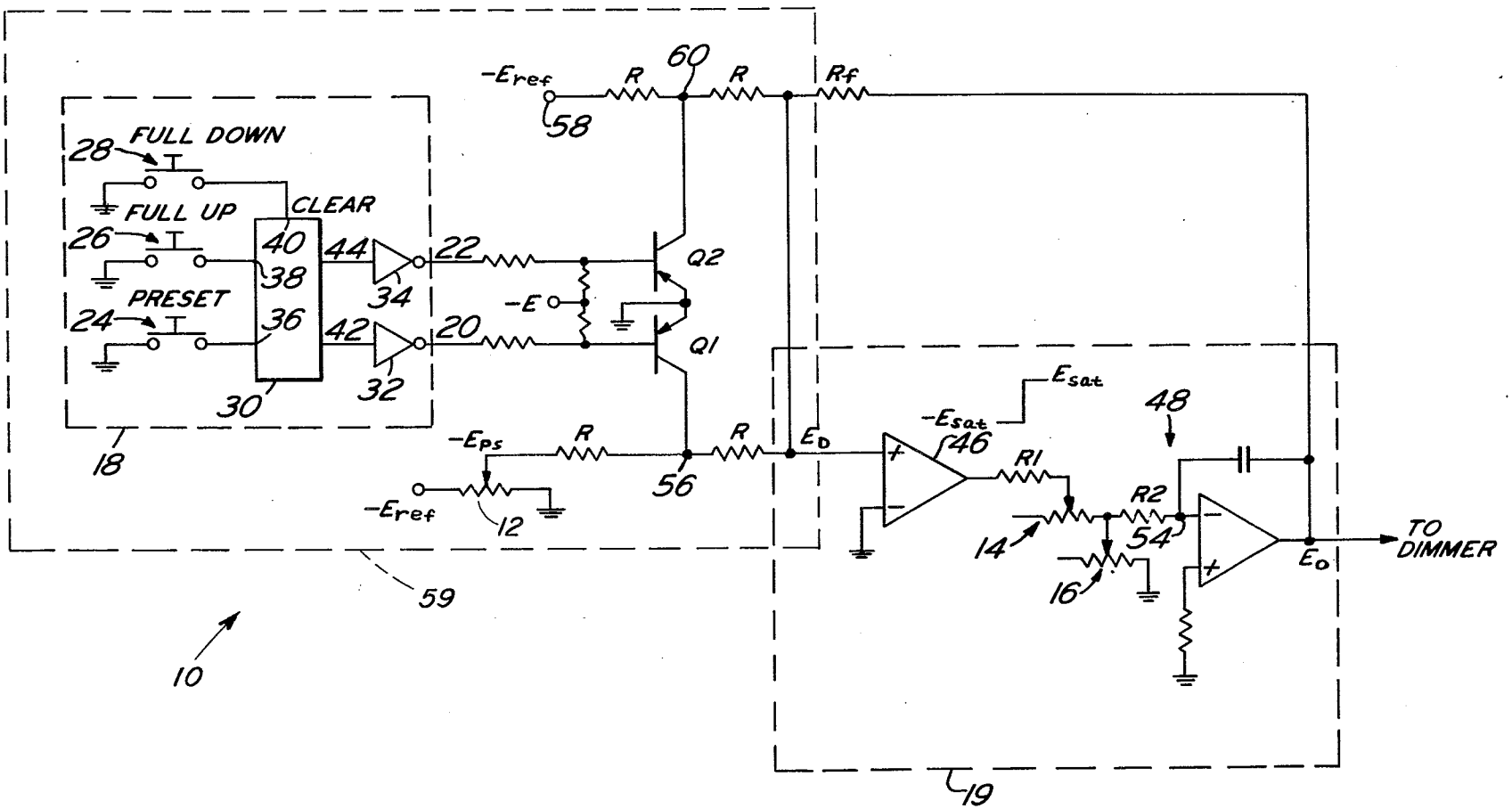
FIG. 1 is a circuit diagram of a fade timer circuit representing the first embodiment of the herein-disclosed invention.

Referring now to the drawings wherein like numerals indicate like elements, there is shown in FIG. 1 a fade timer circuit designated generally as 10. Fade timer circuit 10 is a control device for raising or lowering the intensity of a group of lights. More particularly, fade timer circuit 10 generates an output voltage $E_o$ which controls the power output of a variable output dimmer 11 which, in turn, supplies power to the group of lights whose intensity is to be controlled by fade timer circuit 10. Fade timer circuit 10 operates in three modes: a full up mode, a full down mode, and a preset mode. In the full up mode, the output voltage $E_o$ increases from some pre-existing value to some maximum value determined by reference voltage $E_{ref}$. In the full down mode, the output reference voltage $E_o$ decreases from some pre-existing value to zero volts D.C. In the preset mode, the output reference voltage $E_o$ either increases or decreases from some pre-existing value to a preset value determined by the voltage $E_{ps}$ at the slide arm of potentiometer 12. In each of the above modes, $E_o$ increases or decreases in a substantially linear ramp-like manner. As will be shown in greater detail below, the slope of the ramp output, and therefore the time it takes for $E_o$ to transfer from one level to the next is controllable by setting potentiometers 14 and 16, thereby providing fade time control over the intensity of the lights being controlled by fade timer circuit 10.

Whether fade timer circuit 10 operates in the full up, full down or preset mode is determined by the condition of output terminals 20 and 22 of selector circuit 18. Selector circuit 18 comprises pushbutton switches 24, 26 and 28, memory latch 30, and inverters 32 and 34. Each pushbutton switch 24, 26 and 28 is a normally open switch which is biased in the open condition and will remain open unless external force is applied thereto. One terminal of each pushbutton switch 24, 26 and 28 is connected to ground; the other terminal of each pushbutton switch 24, 26 and 28 is connected to a different input terminal 36, 38 or 40, respectively, of memory latch 30. As such, each normally "high" input terminal 36, 38 and 40 will go "low" when the pushbutton switch to which it is connected is closed. As used herein, a "high" voltage level corresponds to a binary logic state usually designated as "1" and a "low" voltage level corresponds to a binary logic state usually designated as "0". In general, all voltage levels below a specified logic threshold voltage are considered to be "low," and all voltage levels above that threshold voltage are considered to be "high." Consequently, when a voltage signal crosses the logic threshold voltage, there is a transition between the "low" and the "high" levels; in other words, there is a transition between binary logic states.

Memory latch 30 is a two input memory circuit with clear control. Such latch circuits are well known in the art and need not be described structurally. Whenever a momentary "low" is applied to input terminal 36, output terminal 42 will latch "low" and output terminal 44 will latch "high". Conversely, whenever a momentary "low" is applied to input terminal 38, output terminal 44 will latch "low" and output terminal 42 will latch "high". Finally, whenever a momentary "low" is applied to clear input terminal 40, any "lows" at output terminals 42 or 44 will be cleared and both outputs will latch "high".

Each inverter 32, 34 is a binary logic device which will produce a "high" or a "low" voltage level at its output terminal depending upon the level of the voltage applied to its input terminal. Particularly, when a "high" is applied to its input, a "low" will be produced at its output. Conversely, if a "low" is applied to its input, a "high" will appear at its output.

When fade timer circuit 10 is to operate in the full up mode, pushbutton switch 26 is depressed, output terminals 20 and 22 of selector circuit 18 will be "low" and "high", respectively. More particularly, when pushbutton switch 26 is depressed, input terminal 38 of memory latch 30 will go "low" and the output terminals 42 and 44 of memory latch 30 will latch "high" and "low," respectively. The "high" at output terminal 42 is applied to the input terminal of inverter 32 and will cause output terminal 20 of selector circuit 18 to go "low". Similarly, the "low" at output terminal 44 is applied to the input terminal of inverter 34 and will cause output terminal 22 of selector circuit 18 to go high.

When fade timer circuit 10 is to operate in the preset mode, pushbutton switch 24 is depressed and output terminals 20 and 22 of selector circuit 18 will be "high" and "low", respectively. More particularly, when pushbutton switch 24 is depressed, input terminal 36 of memory latch 30 will go "low" and output terminals 42 and 44 of memory latch 30 will latch "low" and "high", respectively. The "low" at output terminal 42 is applied to the input of inverter 32 and will cause output terminal 20 of selector circuit 18 to go "high". Similarly, the "high" at output terminal 44 of memory latch 30 is applied to the input terminal of inverter 34 and will cause output terminal 22 of selector circuit 18 to go "low."

When fade timer circuit 10 is to operate in the full down mode, pushbutton switch 28 is depressed and output terminals 20 and 22 of selector circuit 18 will both be "low". More particularly, when pushbutton switch 28 is depressed, clear input terminal 40 of memory latch 30 will go "low" and output terminals 42 and 44 of memory latch 30 will both latch high. The high at output terminals 42 and 44 is applied to the inputs of inverters 32 and 34, respectively and will cause output terminals 20 and 22 to go low.

In review, the condition of output terminals 20 and 22 during the full up, preset and full down modes will be as follows:

Table 1

| Mode of Operation | 20 | 22 |
|---|---|---|
| full up | low | high |
| full down | low | low |
| preset | high | low |

The second major subcircuit of fade timer circuit 10 is integrator circuit 19. Integrator circuit 19 comprises comparator 46 and an integrator 48. Comparator 46 is a null seeking comparator exhibiting high open loop gain characteristics. Since its inverting input is clamped to ground, comparator 46 will produce a zero volt D.C. output voltage whenever the voltage level $E_D$ at its non-inverting input is zero volts D.C. Due to its high open loop gain characteristics, however, the output of comparator 46 will jump to its positive saturation value $E_{sat}$ whenever the voltage level $E_D$ becomes positive. Conversely, whenever the voltage level $E_D$ becomes negative, the output of comparator 46 will jump to its negative saturation value $-E_{sat}$. The output voltage of comparator 46 is fed into the summing junction 54 of integrator 48 through resistors R1 and R2 and potentiometers 14 and 16. Potentiometer 14 is a timing potentiometer which, as shown below, will dictate the transition time for output voltage $E_o$ of integrator 48 to change from one voltage level to another. Potentiometer 16 is a bleeding resistor which adjusts the input current into the summing junction 54 to calibrate the integrator 48. Integrator 48 is a conventional integrator whose output voltage $E_o$ will increase or decrease in a ramp-like manner whenever the voltage signal applied to its inverting input terminal is at some steady state D.C. value. More particularly, integrator 48 will generate a positive ramp output voltage having a slope proportional to the equivalent resistance of resistors R1 and R2 and potentiometers 14 and 16 when the output voltage of comparator 46 is at its negative saturation value $-E_{sat}$. Conversely, integrator 48 will generate a negative ramp output voltage $E_o$ also having a slope proportional to the equivalent resistance of resistors R1 and R2 and potentiometers 14 and 16 when the output voltage of comparator 46 is at its positive saturation value $E_{sat}$. When the output voltage of comparator 46 is at 0 volts D.C., the output voltage $E_o$ will remain in a steady state condition. Since the slope of the increasing or decreasing ramp voltage $E_o$ is dependent upon the equivalent resistance of resistors R1 and R2 and potentiometers 14 and 16, it is possible to control the fade time in which the output voltage $E_o$ of integrator 48 changes from one voltage level to another by merely adjusting the potentiometers 14 to a desired value.

The operation of integrator circuit 19 can best be understood with reference to an actual application of fade timer circuit 10. If the lights being controlled by fade timer circuit 10 are at blackout ($E_o$ is at zero volts D.C.) and the intensity of the lights is to be increased to peak brightness, pushbutton switch 26 is depressed and circuit 10 is actuated into the full up mode. When pushbutton switch 26 is depressed, the two output terminals 20 and 22 of selector circuit 18 will be "low" and "high", respectively. The "low" at output terminal 20 causes a negative voltage to appear at the base of transistor Q1. The negative voltage at the base of transistor Q1 turns the transistor on and clamps its collector (and therefore junction 56) to ground. The "high" at output terminal 22 causes a positive voltage to appear at the base of transistor Q2. The positive voltage at the base of transistor Q2 turns the transistor off and the collector thereof is essentially an open circuit. In this condition, the negative reference voltage $-E_{ref}$ at terminal 58 causes the input voltage $E_D$ at input terminal 50 of comparator 46 to be negative (both the voltage at terminal 56 and $E_D$ are initially zero volts D.C.). Since the input voltage $E_D$ is negative, the output voltage of comparator 46 will be at its negative saturation voltage $-E_{sat}$. The negative saturation voltage $-E_{sat}$ appearing at the output of comparator 46 drives integrator 48 causing the output voltage $E_o$ of integrator 48 to increase in a ramp-like manner. Due to the integrating action of integrator 48, the output voltage $E_o$ will continue to increase in this manner until the output voltage of comparator 48 either jumps to its positive saturation voltage $E_{sat}$ or to 0 volts D.C. As the magnitude of the output voltage $E_o$ increases, it will counteract the effect of the negative reference voltage $-E_{ref}$ and cause input voltage $E_D$ to become increasingly less negative. As the magnitude of output voltage $E_o$ continues to rise, it will finally reach a null condition voltage $E_{null}$ wherein it completely offsets the negative reference voltage $-E_{ref}$ and causes the input voltage $E_D$ of comparator 46 to attain the zero voltage level (i.e., the null condition). This condition will result when $E_o = E_{ref}(R_f/2R)$. When the null condition occurs, the output of comparator 46 will jump to zero volts D.C. and cease driving integrator 48. It should be recognized by those skilled in the art that the output of comparator 46 does not actually remain at a steady zero volts dc level. More accurately, the output signal while having an average value of zero volts dc, in fact fluctuates between some minimum and maximum value at a very high frequency. In the interest of simplicity, however, the null condition output of comparator 46 will be referred to as the zero volts dc level.

In an ideal circuit, the integrating action of integrator 48 would stop and $E_o$ would remain at the null condition voltage $E_{null}$. However, since integrator circuit 19 is an analog circuit, it tends to drift and $E_o$ may rise or fall above or below the null condition voltage. When this happens, the null seeking action of comparator 46 will act as a governor and return the output voltage $E_o$ to its null condition voltage $E_{null}$. More particularly, if the output voltage $E_o$ rises above the null seeking voltage level, the input voltage $E_D$ to comparator 46 will go positive and the output of comparator 46 will jump to its positive saturation value $E_{sat}$. The positive saturation voltage at the output of comparator 46 will drive integrator 48 in a negative direction and decrease the output voltage $E_o$ in a ramp-like manner until it again reaches the null condition voltage $E_{null}$. This will cause the input voltage $E_D$ to comparator 46 to again reach the null condition causing the output voltage of comparator 46 to return to the zero volts D.C. level and to cease driving integrator 48. Similarly, if the output voltage $E_o$ falls below the null seeking voltage level $E_{null}$, the input voltage $E_D$ to comparator 46 will go negative and the output of comparator 46 will jump to its negative saturation value $-E_{sat}$. The negative saturation voltage at the output of comparator 46 will drive the integrator 48 in the positive direction and the output voltage $E_o$ will increase in a ramp-like manner until it again reaches the null condition voltage $E_{null}$. At this point, the input voltage $E_D$ to comparator 46 will again reach the null condition causing the output voltage of comparator 46 to return to the zero volts D.C. level and to cease driving integrator 48. In summary, when pushbutton switch 26 is depressed, the output voltage $E_o$ of integrator 48 will rise in a ramp-like manner until it reaches a null condition voltage $E_{null}$ $E_{ref}(R_f/2R)$ and will remain at that voltage until the selector circuit 18 is switched into a different mode.

While the above discussion assumed that the intensity of the lights controlled by fade timer circuit 10 was at blackout (and $E_o$ at zero volts D.C.) when fade timer circuit 10 was first switched into the full up mode, there will be many applications where the intensity of the lights is greater than blackout but less than peak brightness when the full up mode is initiated. In these applications, the above analysis remains correct except that $E_o$ will initially be at some positive voltage greater than zero volts D.C. but less than the null condition voltage $E_{ref}$ $(R_f/2R)$, and will increase in a ramp-like manner from the pre-existing value to the $E_{null}$ value.

Once the intensity of the lights being controlled by fade timer circuit 10 is at peak brightness, it may be desired to decrease their intensity to some preset value. If this is the case, pushbutton switch 24 is depressed and circuit 10 is actuated into the preset mode. When pushbutton switch 24 is depressed, output terminals 20 and 22 of selector circuit 18 go "high" and "low", respectively. The "high" at output terminal 20 causes a positive voltage to appear at the base of transistor Q1. The positive voltage at the base of transistor Q1 turns the transistor off and the collector thereof is essentially an open circuit. The "low" at output terminal 22 causes a negative voltage to appear at the base of transistor Q2. The negative voltage at the base of transistor Q2 turns the transistor on and clamps its collector (and therefore junction 60) to ground. It should be noted at this time that the preset voltage $-E_{ps}$ at the slide arm of potentiometer 12 is, in the preferred embodiment, some fraction of the negative reference voltage $-E_{ref}$ applied to terminal 58. If it is remembered that $E_o = E_{ref}(R_f/2R)$ when fade timer circuit 10 is first switched from the full up to the preset mode, it will be seen that the input voltage $E_D$ to comparator 46 will be positive. More particularly, the voltage $E_D$ will equal $(E_{ref} - kE_{ref})/R$ wherein k is some fraction between zero and one and is determined by the positioning of the slide arm of potentiometer 12. As noted above, when $E_D$ is positive, the output $E_o$ of integrator 48 will decrease in a ramp-like manner until it reaches the null condition voltage $E_{null}$ wherein the input voltage $E_D$ to comparator 46 is zero volts D.C. In the preset mode of operation, this condition will occur when $E_o = E_{ps}$ $(R_f/2R)$. As such, the output voltage $E_o$ will decrease in a ramp-like manner until it reaches the null condition voltage $E_{null} = E_{ps}$ $(R_f/2R)$. As noted above, $E_o$ will be retained at the null condition voltage by the null seeking characteristics of comparator 46. If the intensity of the lights is thereafter to be raised or lowered to some magnitude other than blackout or peak brightness, the slide arm 12 will be adjusted to the desired setting and the output voltage $E_o$ of integrator 48 will again seek the null condition voltage which is dictated by the value of the new preset voltage $-E_{ps}$.

If it is desired to decrease the intensity of the lights from any preset level (or from peak intensity) to blackout, pushbutton switch 28 is depressed. When pushbutton switch 28 is depressed, the two output terminals 20 and 22 of selector circuit 18 will both be low. The low at terminals 20 and 22 cause a negative voltage to appear at the base of both transistors Q1 and Q2. The negative voltage at the base of transistors Q1 and Q2 turns both transistors on and clamps their collectors (and therefore junctions 56 and 60) to ground. In this condition, the positive voltage $E_o = E_{ps}$ $(R_f/2R)$ at the output terminal 52 of integrator 48 causes the input voltage $E_D$ to comparator 46 to be positive. As described above, this will cause the output voltage $E_o$ of integrator 48 to decrease in a ramp-like manner until the output voltage $E_o$ reaches the null condition voltage wherein the input voltage $E_o$ to comparator 46 is zero volts D.C. In particular, since junctions 56 and 60 are both clamped to ground during the full down mode, the null condition voltage $E_{null}$ is zero volts D.C. As such, $E_o$ will decrease from some pre-existing voltage to zero volts D.C. when fade timer circuit 10 operates in the full down mode.

From the foregoing it is apparent that selector circuit 18, potentiometer 12, transistors Q1 and Q2 and associated resistors combine to form a command signal generator circuit 59 which generates a command signal controlling the value of output signal $E_o$. In the preferred embodiment, command signal generator circuit 59 generates a command signal having a value of $E_{ref}$ $(R_f/2R)$ when full up pushbutton switch 26 is depressed, a value of $E_{ps}$ $(R_f/2R)$ when preset pushbutton switch 24 is depressed, and zero volts DC when full down pushbutton switch 28 is depressed. More generally, command signal generator circuit 59 generates a command signal which is compared to output signal $E_o$ by comparator 46 and determines the final magnitude of output signal $E_o$.

In review, fade timer circuit 10 will produce an output voltage $E_o$ which either increases or decreases in a ramp-like manner from some pre-existing steady state value to some final value determined by a command signal (i.e., $E_{ref}$, $E_{ps}$ or 0 volts D.C.) selected by selector circuit 18. More particularly, when fade timer circuit 10 is in the full up mode, the output voltage $E_o$ of integrator 48 rises from some pre-existing value to a maximum value $E_{ref}$ $(R_f/2R)$. When fade timer circuit 10 is in the preset mode, the output voltage $E_o$ either increases or decreases from some preexisting value to some preset value $E_{ps}$ $(R_f/2R)$. Finally, when fade timer circuit 10 is in the full down mode, the output voltage $E_o$ decreases from some pre-existing value to zero volts D.C.

Figure 2:
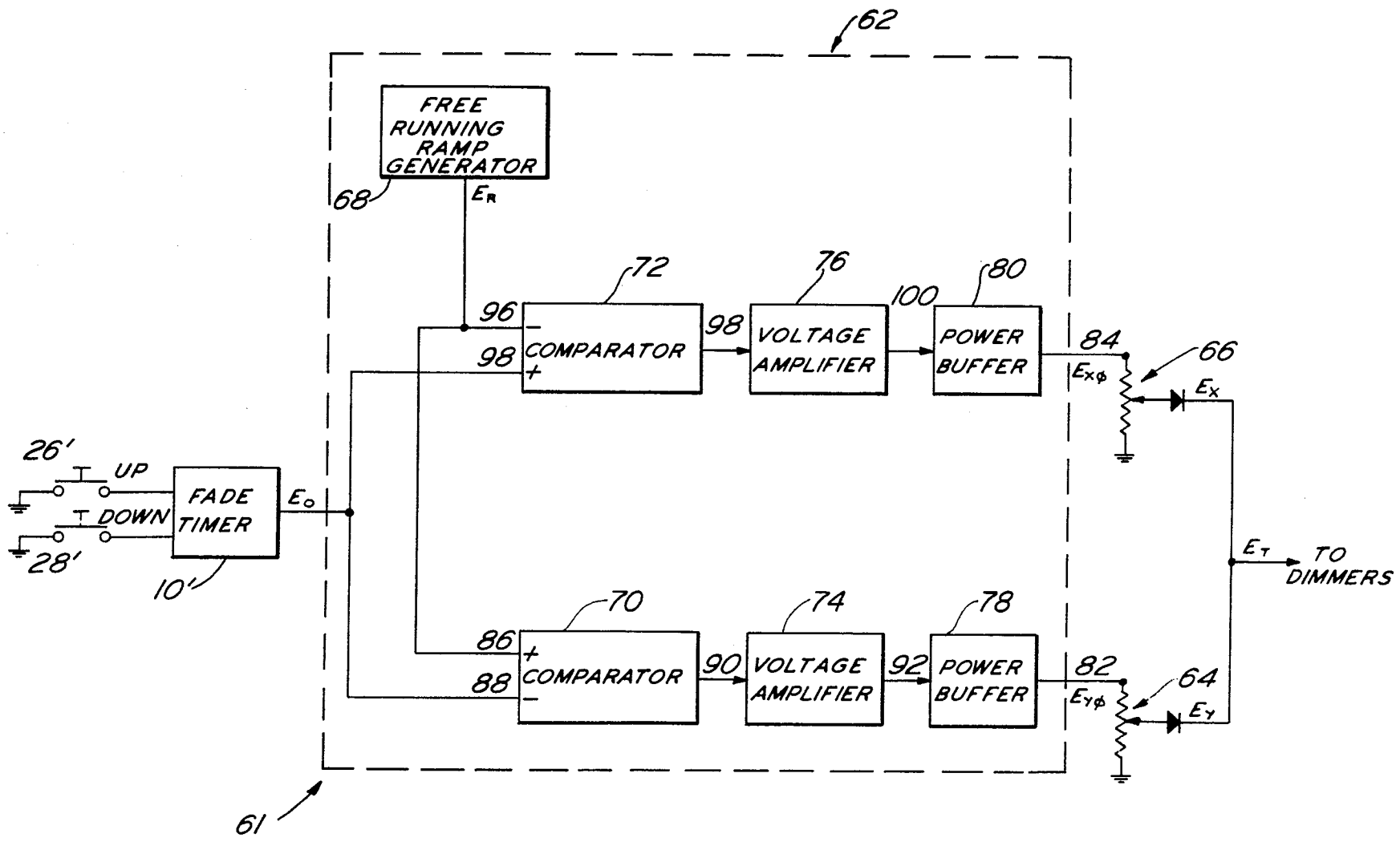
FIG. 2 is a block diagram of a fade timer and a voltage to pulse width converter circuit representing the second embodiment of the herein-disclosed invention.
Figure 3:
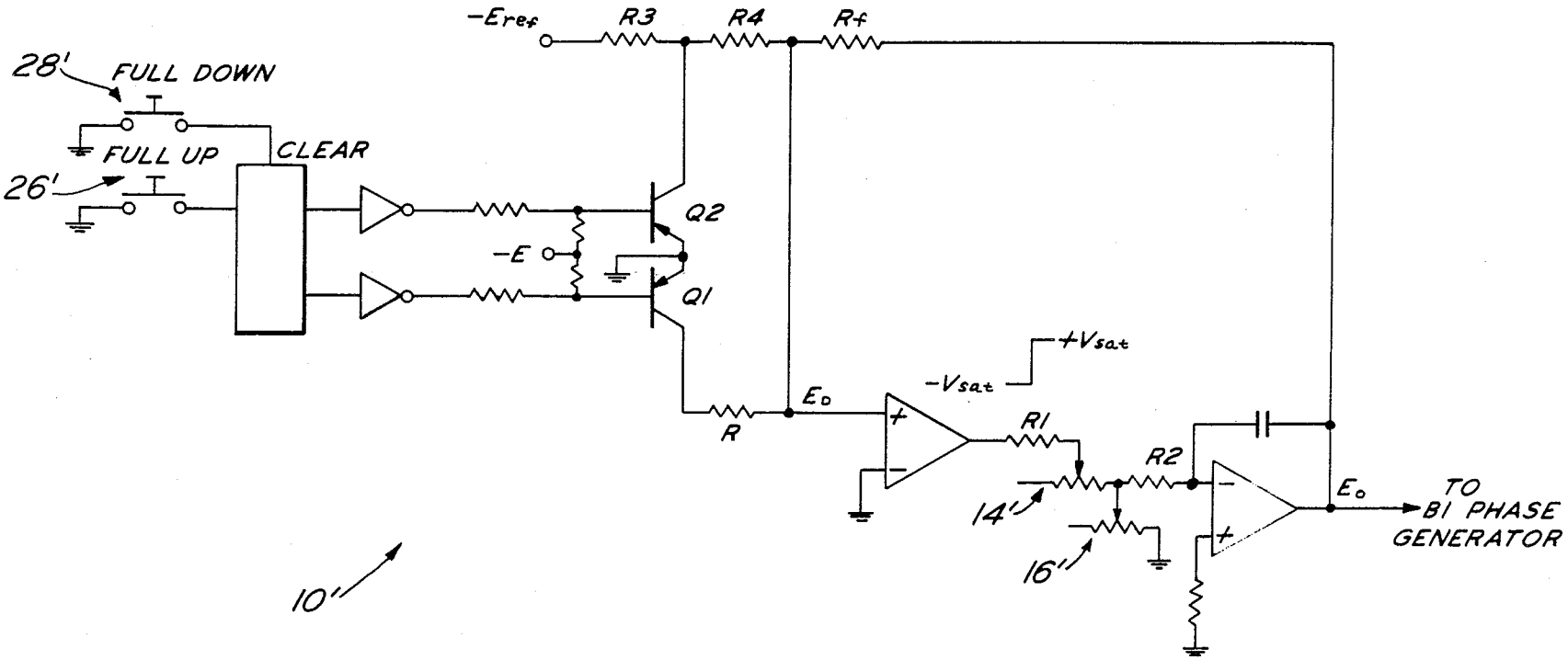
FIG. 3 is a modified fade timer circuit employed in the second embodiment of the herein-disclosed invention.

The above described application of fade timer circuit 10 provides a means for switching the intensity of a group of lights between full intensity, blackout, and any desired preset level, by merely depressing a pushbutton switch. It is often desirable, however, to be able to switch the intensity of a group of lights from one preset value to another preset value (other than blackout or peak intensity). While the fade timer circuit 10 does permit such changes, they must be made manually by physically readjusting the slide arm of potentiometer 12. In a second embodiment of the herein-disclosed invention designated generally as circuit 61, a voltage to pulse width converter circuit 62 is connected to a fade timer circuit 10' to provide a means for automatically switching the intensity of a group of lights between two preset values by merely depressing a pushbutton switch. Referring to FIG. 2, there is shown a block diagram of circuit 61. A modified fade timer circuit 10' (shown in FIG. 3) is connected to a voltage to pulse width converter circuit 62 and a pair of potentiometers 64 and 66. Fade timer circuit 10' is identical to fade timer circuit 10 in all respects except that pushbutton switch 24 and potentiometer 12 have been omitted. As such, the modified fade timer circuit 10' only operates in the full up or full down mode. More particularly, when pushbutton switch 26' is depressed, fade timer circuit 10' will be in the full up mode and will generate an output signal $E_o$ starting at zero volts D.C. and rising to its null condition voltage $E_{null} = E_{ref}$ $(R_f/2R)$ in a time T determined by the setting of potentiometer 14'. As will be shown in greater detail below, this will cause control over the intensity of the lights to fade from potentiometer 64 to potentiometer 66 in T seconds time. When pushbutton switch 28 is depressed, fade timer circuit 10' will be in the full down mode, and will generate an output signal $E_o$ starting at the null condition voltage $E_{null} = E_{ref}$ $(R_f/2R)$ and falling to zero volts D.C. also in time T. As will be shown in greater detail below, this will cause control over the intensity of the lights to fade from potentiometer 66 to potentiometer 64 in T seconds time.

Figure 5:
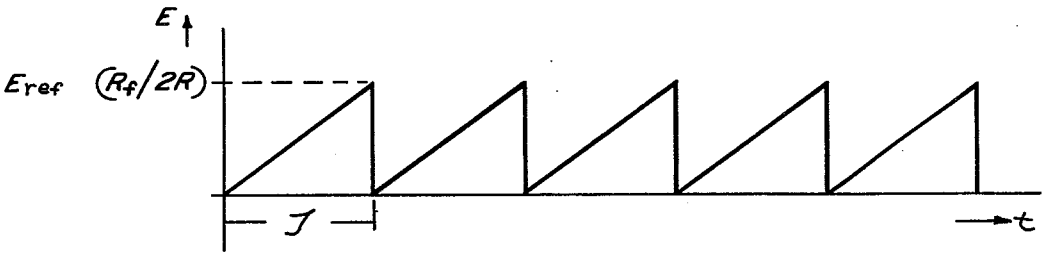
FIG. 5 is a graph of the ramp output of a pulse generator.

The output voltage $E_o$ of fade timer circuit 10' is applied to the voltage to pulse width converter circuit 62. Voltage to pulse width converter circuit 62 comprises a free running ramp generator 68, comparators 70 and 72, voltage amplifiers 74 and 76, and power buffers 78 and 80, and transfers control over the intensity of the lights being controlled by circuit 61 between potentiometers 64 and 66 in response to the output signal $E_o$ generated by fade timer circuit 10'. Free running ramp generator 68 generates a series of ramp voltage signals whose wave form is illustrated in FIG. 5. Particularly, free running ramp generator 68 generates a series of ramp output voltages starting at zero volts D.C. and rising to a maximum voltage of $E_{ref}$ $(R_f/2R)$ in time $\tau$. Time $\tau$ is significantly shorter than the time period T in which the output voltage $E_o$ of fade timer circuit 10' rises from zero volts D.C. to its maximum value $E_{ref}$ $(R_f/2R)$. Particularly, in the preferred embodiment, time $\tau$ is approximately $4 \times 10^{-4}$ seconds while time T varies betwen 1 and 60 seconds.

Comparator 70 compares the voltage level of the signal applied to its non-inverting input terminal 86 and the voltage level of the signal applied to its inverting input terminal 88. More particularly, if the voltage level of the signal at its non-inverting input 86 is greater than the voltage level of the signal at its inverting input terminal 88, comparator 70 generates a positive output voltage at its output terminal 90 equal to its positive saturation voltage $E'_{sat}$. If the voltage level of the signal applied to its non-inverting input terminal 86 is less than the voltage level of the signal applied to its inverting input terminal 88, comparator 70 generates a negative output voltage at its output terminal 90 equal to its negative saturation output voltage $-E'_{sat}$. Finally, if the voltage level of the signal applied to its non-inverting input terminal 86 is equal to the voltage level of the signal applied to its inverting input terminal 88, comparator 70 will generate a zero D.C. output voltage at its output terminal 90.

Figure 4:
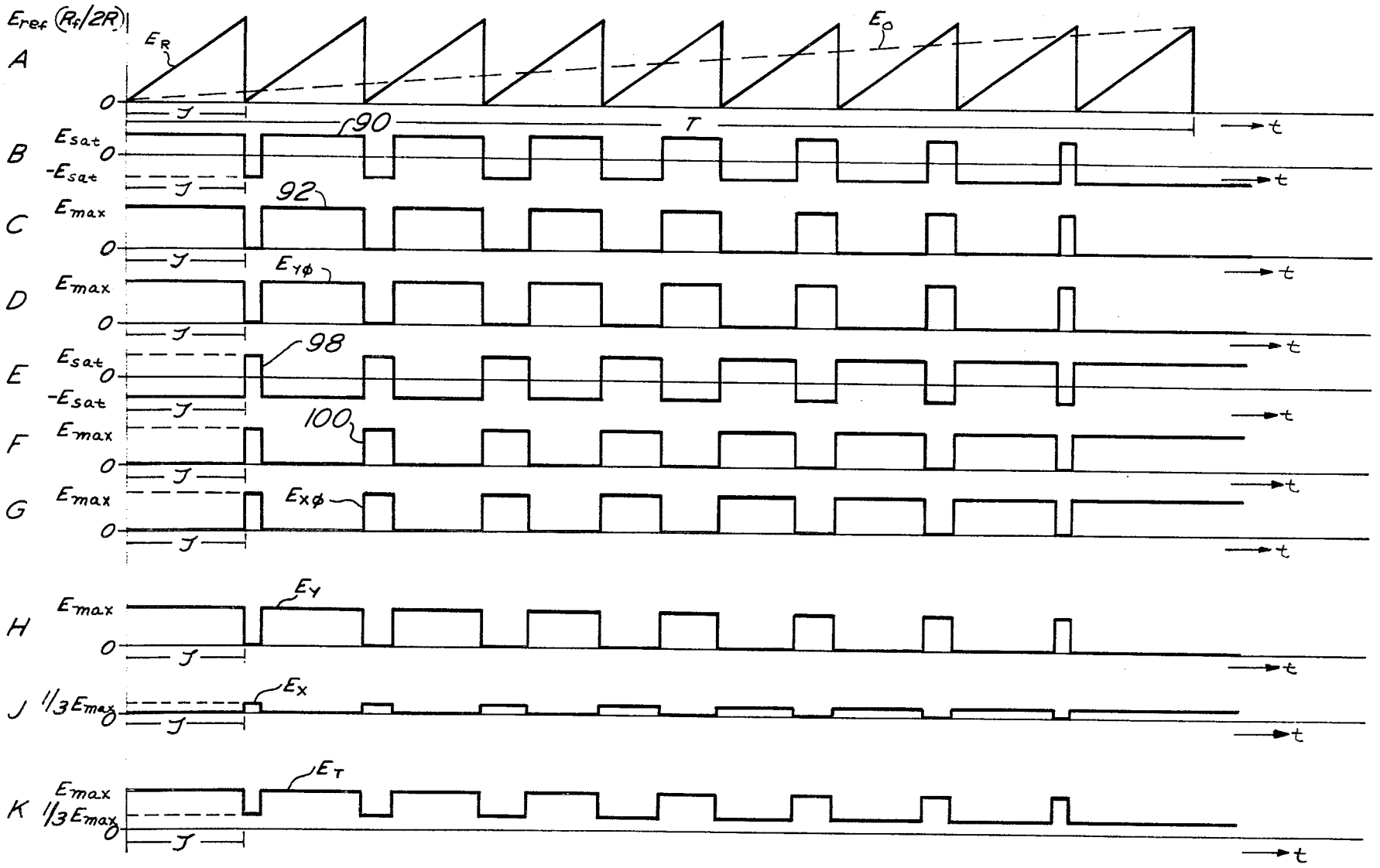
FIG. 4 is a series of graphs representing the voltage wave forms at various points of the block diagram illustrated in FIG. 2.

The two voltage signals compared by comparator 70 are shown superimposed in graph A of FIG. 4. More particularly, the wave form shown as a solid line and identified as $E_R$ represents the output of free running ramp generator 68 which is being applied to the non-inverting input terminal 86 of comparator 70, and the broken line wave form identified as $E_o$ represents the wave form of the output voltage $E_o$ of fade timer circuit 10' which is applied to the inverting input 88 of comparator 70. As clearly illustrated, fade timer circuit 10' functions as a second ramp generator. In accordance with the above described operating characteristics of comparator 70, the output voltage at output terminal 90 of scomparator 70 will be at its positive saturation value $E'_{sat}$ whenever the amplitude of the voltage signal $E_R$ is greater than the amplitude of the voltage signal $E_o$. Conversely, whenever the amplitude of the voltage signal $E_o$ is greater than the amplitude of the voltage signal $E_R$, the output voltage at output terminal 90 of comparator 70 will be at its negative saturation voltage $-E'_{sat}$. The resultant voltage wave form appearing at output terminal 90 of comparator 70 during the full up mode of fade timer circuit 10' is illustrated in graph B of FIG. 4 and is identified by the numeral 90. More particularly, the output voltage wave form at terminal 90 will be a pulse width modulated voltage varying between $E'_{sat}$ and $-E'_{sat}$ whose pulse width decreases from a maximum value $\tau$ to a minimum vlaue of zero in T seconds.

The voltage output signal at terminal 90 is applied to voltage amplifier 74 and is modified thereby in two respects. Particularly, a D.C. offset voltage is added so that the wave form is always positive, and the maximum value of the wave form is adjusted to some desired maximum value $E_{max}$. The wave form of the output voltage appearing at output terminal 92 of voltage amplifier 74 is illustrated in graph C of FIG. 4 and is identified by the numeral 92. As shown therein, the output voltage wave form will be a pulse width modulated voltage varying between $E_{max}$ and zero volts D.C. whose pulse width decreases from a maximum value of $\tau$ to a minimum value of zero in T seconds.

The output wave appearing at output terminal 92 of voltage amplifier 74 is applied to power buffer circuit 78. Power buffer circuit 78 boosts the power of the voltage output of voltage amplifier 74 (so that a large number of pairs of potentiometers may be driven by a single circuit 61) without in any way changing the voltage wave form thereof. The resultant output voltage wave form at output terminal 82 of voltage to pulse width converter circuit 62 is shown in graph D of FIG. 4 and is identified as $E_{y\phi}$ , the y phase output voltage of voltage to pulse width converter circuit 62. It should be noted at this point that the output wave form shown in graph D only illustrates the output wave form of the y phase output voltage $E_{y\phi}$ during the transition mode of the voltage to pulse width converter circuit 62. During the steady state mode, wherein the output of fade timer circuit 10' is either at zero volts D.C. or at the $E_{null}$ voltage $E_{ref}(R_f/2r)$, the y phase output voltage $E_{y\phi}$ of voltage to pulse width converter circuit 62 will be zero volts D.C. and $E_{max}$, respectively.

Comparator 72 is identical to comparator 70 and also compares the voltage level of the output voltage $E_o$ of fade timer circuit 10' and the voltage level of the output voltage $E_R$ of the free running ramp generator 68. However, since the inputs are reversed (i.e., the output voltage $E_o$ of fade timer circuit 10' is applied to the non-inverting input terminal 94 of comparator 72 and the output voltage $E_R$ of free running ramp generator 68 is applied to the inverting input terminal 96 of comparator 72), the output voltage wave form at output terminal 98 of comparator 72 will be a mirror image of the output voltage wave form at terminal 92 of comparator 70. More particularly, the output voltage at output terminal 98 of comparator 72 will be at its negative saturation voltage $-E'_{sat}$ when the voltage signal $E_R$ is greater than the voltage signal $E_o$, and the output voltage at output terminal 98 of comparator 72 will be at its positive saturation voltage $E'_{sat}$ when the voltage signal $E_o$ is greater than the voltage signal $E_R$. The resultant output voltage wave form at output terminal 98 is illustrated in graph E of FIG. 4 and is identified by the numeral 98. More particularly, the output voltage wave form at terminal 98 will be a pulse width modulated voltage varying between $E'_{sat}$ and $-E_{sat}$ whose pulse width increases from a minimum value of zero to a maximum value $\tau$ in T seconds.

The voltage output wave form at terminal 98 is applied to voltage amplifier 76 and is modified thereby in the same manner as voltage amplifier 74 modified the voltage output wave form at output terminal 90 of comparator 70. Particularly, a D.C. offset voltage is added so that the resultant wave form is always positive, and the maximum value of the wave form is adjusted to some desired maximum value $E_{max}$. The wave form of the output voltage appearing at output terminal 100 of voltage amplifier 76 is illustrated in graph F of FIG. 4 and is identified by the numeral 100. As shown therein, the output voltage wave form will be a pulse width modulated voltage varying between $E_{max}$ and zero volts D.C. whose pulse width decreases from a maximum value of $\tau$ to a minimum value of zero in T seconds.

The output voltage appearing at output terminal 100 of voltage amplifier 70 is applied to power buffer circuit 80. Power buffer circuit 80 boosts the power of the voltage output of voltage amplifier 76 (so that a large number of pairs of potentiometers may be driven by a single circuit 61) without in any way changing the voltage wave form thereof. The resultant output voltage wave form at output terminal 84 of voltage to pulse width converter circuit 62 is shown in graph G of FIG. 4 and is identified as $E_{x\phi}$ , the x phase output voltage to pulse width converter circuit 62. It should be noted at this point that the output wave form shown in graph G only illustrates the output wave form $E_{x\phi}$ during the transition mode of the voltage to pulse width converter circuit 62. During the steady state mode wherein the output $E_o$ of fade timer circuit 10' is either zero volts D.C. or the $E_{null}$ voltage $E_{ref}$ ($R_f$/2R), the x phase output voltage $E_{x\phi}$ of voltage to pulse width converter circuit 62 will be $E_{max}$ and zero volts D.C., respectively.

The y phase output voltage $E_{y\phi}$ appearing at output terminal 82 of voltage to pulse width converter 62 is applied to the top of potentiometer 64. Similarly, the x phase output voltage $E_{x\phi}$ appearing at output terminal 84 of voltage to pulse width converter 62 is applied to the top of potentiometer 66. Assuming that the output voltage $E_o$ of fade timer circuit is at zero volts D.C., the *y* phase output voltage at output terminal 82 will be at its maximum value $E_{max}$ and the *x* phase output voltage at output terminal 84 will be at zero volts D.C. In this condition, the output voltage $E_T$ will be equal to the output voltage $E_y$ appearing at the slide arm of potentimeter 54. Output voltage $E_T$ will be applied to a set of dimmers that supply power to the lights being controlled by circuit 10. The dimmers may be any variable output set of dimmers whose power output is controlled by the magnitude of a control signal applied thereto. As such, the intensity of the lights will be set at the level selected by potentiometer 64.

If pushbutton 26' is depressed, fade timer circuit 10 will go into the full up mode and output voltage $E_o$ will rise in ramplike manner causing the y phase output voltage $E_{y\phi}$ and the x phase output voltage $E_{x\phi}$ at output terminals 82 and 84, respectively, of voltage to pulse width converter circuit 64 to vary in the manner illustrated in graphs D and G of FIG. 4, respectively. Assuming that the slide arm of potentiometer 64 is set at its maximum value such that the voltage $E_y$ will be equal to the *y* phase output voltage $E_{y\phi}$, and that the slide arm of potentiometer 66 is set at the onethird tap point such that the voltage $E_x$ will be equal to one-third of the x phase output voltage $E_{x\phi}$, the resultant output wave forms $E_y$ and $E_x$ will be as illustrated in graphs H and J, respectively. The total voltage $E_T$ that will be applied to the dimmers is illustrated in graph K of FIG. 4. As shown therein, the output voltage $E_T$ generated by circuit 61 will initially be at the maximum output voltage $E_{max}$ dictated by potentiometer 64 and will gradually fade to the one-third $E_{max}$ value dictated by potentiometer 66. As such, whenever pushbutton switch 26' is depressed, the intensity of the lights controlled by circuit 61 will increase or decrease from a first value dictated by potentiometer 64 to a second value dictated by potentiometer 66 in time T dictated by potentiometer 14' of fade timer circuit 10'.

In light of the above disclosure, it should be recognized by those skilled in the art that when pushbutton switch 28' is depressed, the output voltage $E_o$ of fade timer circuit 10' will decrease in a ramp-like manner from the maximum value $E_{ref}$ ($R_f$/2R), and that the output voltage $E_T$ to the dimmers supplying power to the lights controlled by circuit 61 will rise or fall from a first value dictated by potentiometer 66 to a second value dicated by potentiometer 64 in a time T dicated by potentiometer 14' of fade timer circuit 10'.

The above described embodiment of the herein-disclosed invention provides fade control between two preset intensity levels. If is often desirable, however, to provide a random selection of fades between a larger plurality of presets as well as a fade to blackout. In the third embodiment of the herein-disclosed invention, a four scene preselector circuit is added to fade timer circuit 10' and voltage to pulse width converter circuit 62 to provide such random selection of fades. While the preferred embodiment described herein utilizes a four scene preselector circuit, it should be obvious to those skilled in the art that other preselector circuits controlling a larger number of preset potentiometers could be used without departing from the spirit or scope of the herein-disclosed invention.

Figure 6:
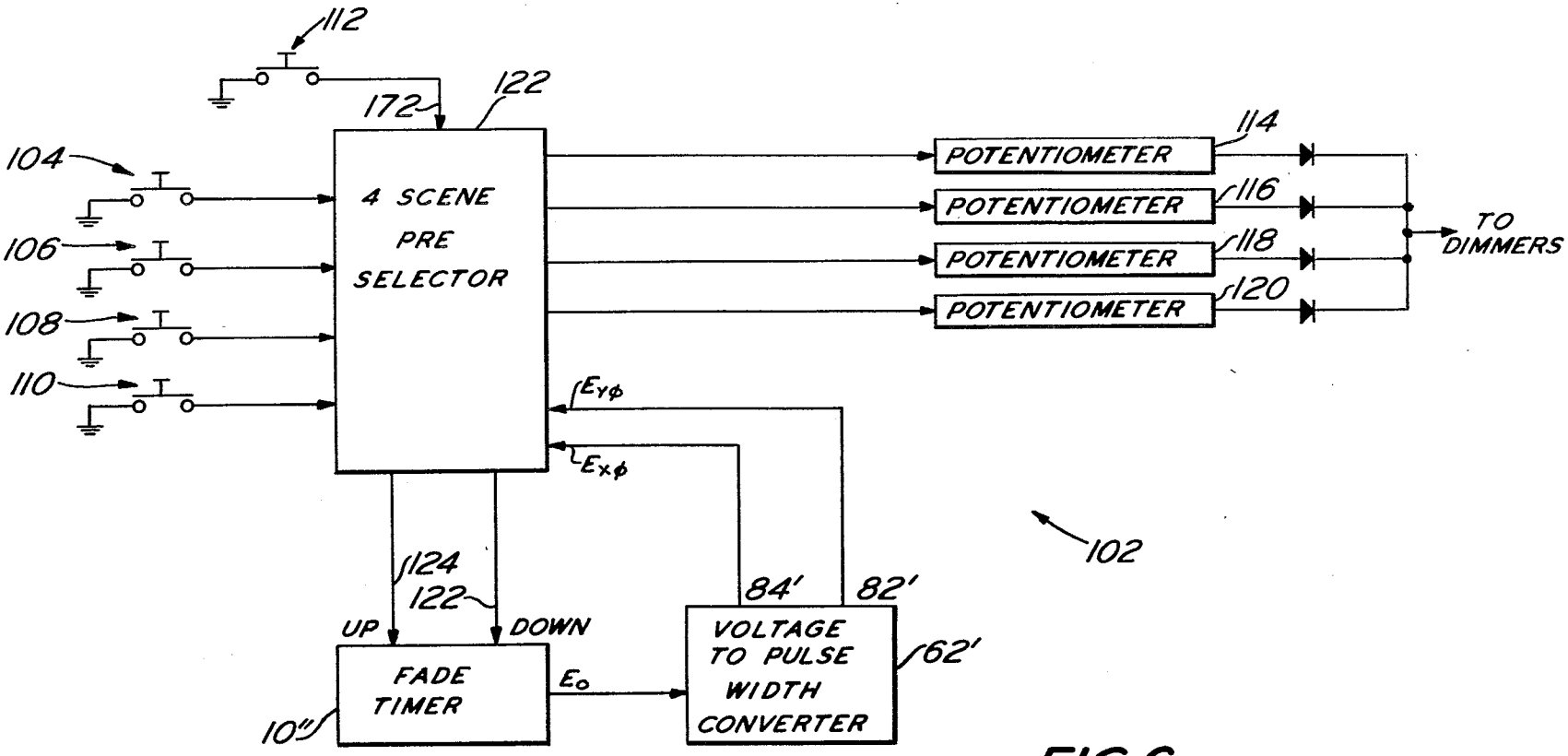
FIG. 6 is a block diagram of the third embodiment of the herein-disclosed invention.
Figure 7:
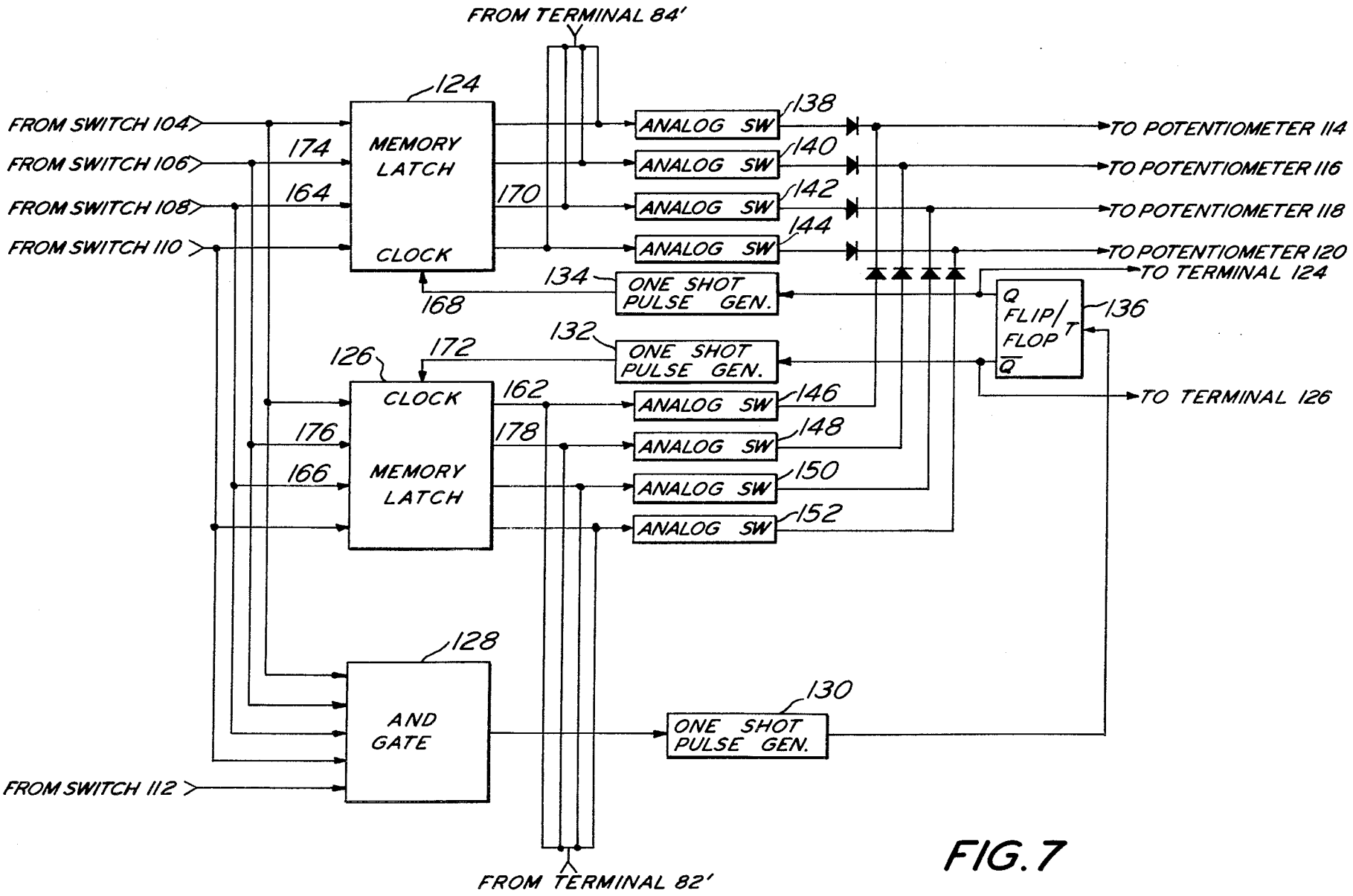
FIG. 7 is a block diagram of the four scene preselector circuit utilized in the third embodiment of the herein-disclosed invention.

Referring to FIG. 6, there is shown a block diagram of the present embodiment of the herein-disclosed invention designated generally as circuit 102. Circuit 102 comprises pushbuttom switches 104, 106, 108, 110 and 112, fade timer circuit 10'', voltage to pulse width converter circuit 62', potentiometers 114, 116, 118 and 120, and four scene preselector circuit 122. Pushbutton switches 104, 106, 108, 110 and 112 are all normally open pushbutton switches that are biased in the open position and will remain open unless an external force is applied thereto. Whenever any pushbutton switch 104, 106, 108, 110 or 112 is depressed, it will produce a momentary addressing signal (a momentary ground) which is applied to the four scene preselector circuit 122. Fade timer circuit 10'' is identical to fade timer circuit 10' and will generate an output signal $E_o$ which rises from zero volts D.C. to a maximum voltage $E_{null}$ $E_{ref}$ ($R_f$/2R) when a "low" is applied to its up input terminal 124 and will generate a output voltage $E_o$ which decreases from a maximum value of $E_{null}$ to a minimum value of zero volts D.C. when a "low" is applied to its down input terminal 126. Voltage to pulse width converter 62' is identical to voltage to pulse width converter 62 and will generate complementary output signals $E_{x\phi}$ at output terminal 84' and $E_{y\phi}$ at output terminal 82'. Potentiometers 114, 116, 118 and 120 are conventional slide arm potentiometers and need not be described in detail. The structure of four scene preselector card 122 is shown in detail in FIG. 7. Four scene preselector card 122 comprises two four input memory latches 124 and 126, NAND gate 128, one shot pulse generators 130, 132 and 134, T flip-flop 136, and analog swithches 138 through 152. Memory latches 124 and 126 are quad latches having four input terminals, four output terminals and one clock enable input terminal. Each memory latch 124, 126 is a memory device whose outputs latch into a new condition whenever a clock pulse is applied to its input terminal. More particularly, when a clock pulse is applied to clock input terminal 168 or clock input terminal 172, memory latch 124 or 126, respectively, will sense the condition of its four input terminals and latch its four output terminals into a condition mimicing the condition of the four input terminals. For example, if a momentary "low" is applied to input terminal 164 of latch means 124, and a clock pulse is applied to its input terminal 168, output terminal 170 of memory latch 124 will latch "low" and the remaining output terminals of memory latch 124 will latch "high".

AND gate 128 is a conventional AND gate whose output will go "low" whenever a momentary "low" is applied to one of its input terminals (it should be remembered that switches 104-112 are all normally open switches). Each one shot pulse generator 130, 132 and 134 generates a positive going spike at its output whenever a momentary "low" is applied to its input. Flip-flop 136 is a T flip-flop whose outputs Q and $\overline{Q}$ will change state whenever a positive going spike is applied to the T input terminal. More particularly, if output Q is "high" and output $\overline{Q}$ is "low" and a positive going spike is applied to the T input terminal, the output terminal Q will go "low" and the output terminal $\overline{Q}$ will go "high". Analog switches 138 through 144 will pass the x phase output voltage $E_{x\phi}$ generated at terminal 84' of voltage to pulse width converter 62' whenever a "low" is applied thereto from one of the output terminals of memory latch 124. More particularly, if a "low" appears at the output terminal 170 of memory latch 124, it will enable analog switch 142 to pass the x phase output voltage $E_{x\phi}$ and thereby apply that voltage to potentiometer 118.

The operation of the four scene preselector circuit 122 as well as control circuit 102 can best be described with reference to an actual application thereof. It will first be assumed that control over the intensity of the lights controlled by circuit 102 is presently at potentiometer 114. It will further be assumed that the output voltage $E_o$ of fade timer circuit 10'' is at zero volts D.C. and therefore that voltage $E_{y\phi}$ at output terminal 82' is at the maximum value $E_{max}$ and that the voltage $E_{x\phi}$ at output terminal 84' is at zero volts D.C. In this condition, output terminal 162 of memory latch 126 will be latched "low" enabling analog switch 146 to pass the $E_{max}$ voltage generated at terminal 82' of voltage to pulse width converter 62'. The voltage $E_{max}$ at the output of analog switch 146 is applied to potentiometer 114. If it is then desired to transfer control over the intensity of the lights controlled by circuit 102 to potentiometer 118, pushbutton switch 108 will be depressed. When pushbutton switch 108 is depressed, it will generate a momentary addressing signal (a momentary "low") at input terminals 164 and 166 of memory latch circuits 124 and 126, respectively. Additionally, the momentary "low" will be applied to AND gate 128 causing a momentary "low" to appear at the output terminal thereof. The momentary "low" at the output terminal of AND gate 128 is applied to one shot pulse generator 130 which generates a positive spike output which is applied to the input of T flip-flop 136. Since potentiometer 114 is being supplied from analog switch 146, T flip-flop is in the $\overline{Q}$ position. The pulse applied to the input of T flip-flop 136 will cause the T flip-flop to toggle from the $\overline{Q}$ to the Q position causing the $\overline{Q}$ output to go "low" and the Q output to go "high". the "low" at the Q output is applied to both terminal 124 of fade timer circuit 10'' and to the one shot pulse generator 134. The "low" applied to the one shot pulse generator 134 will cause a positive spike to be applied to the clock enable input 168 of memory latch 124. This will cause memory latch 124 to latch into a position wherein output terminal 170 of memory latch 124 is "low" and the remaining output terminals of memory latch 124 to latch "high." Memory latch 124 will remain in this condition until a new clock signal is applied to its clock input terminal 168. The "low" at output terminal 170 enables analog switch 142 to pass the $E_{x\phi}$ output voltage generated at output terminal 84' of voltage to pulse width converter 62' to potentiometer 118. As stated above, $E_{x\phi}$ output volage generated at output terminal 84' of voltage to pulse width converter 62' to potentiometer 118. As stated above, $E_{x\phi}$ will initially D.C. and potentiometer 118 will have no control over the intensity of the lights controlled by circuit 102. However, at the same time that the "low" at the Q output of T flip-flop 136 is applied to one shot pulse generator 134, it is also applied to the up input terminal 124 of fade timer circuit 10' causing the output voltage $E_o$ of fade timer circuit 10'' to rise from zero volts D.C. to the maximum value $E_{null} = E_{ref}$ ($R_f$/2R). This will cause output voltages $E_{y\phi}$ and $E_{x\phi}$ at output terminals 82' and 84' of voltage to pulse width converter 62' to vary in the manner described above (see graphs D and G of FIG. 4). As such, control over the intensity of the lights controlled by circuit 102 will fade from potentiometer 114 (which is supplied by voltage $E_{y\phi}$ ) to potentiometer 118 (which is supplied by voltage $E_{x\phi}$ ). More particularly, the intensity of the lights controlled by circuit 102 will fade from the preset level determined by potentiometer 114 to the preset level determined by potentiometer 118 in a time T controlled by potentiometer 16'' of fade timer circuit 10''.

If the intensity of the lights controlled by circuit 102 is thereafter to be transferred to potentiometer 116, pushbutton switch 106 will be depressed. When pushbutton switch 106 is depressed, it will generate a momentary addressing signal (a momentary "low") at input terminals 174 and 176 of memory latch circuits 124 and 126, respectively. Additionally, the momentary "low" will be applied to AND gate 128 causing a momentary "low" to appear at the output terminal thereof. The momentary "low" at the output terminal of AND gate 128 is applied to one shot pulse generate 130 which generates a positive spike output which is applied to the input of T flip-flop 136. Since T flip-flop 136 is presently in the Q position, it will toggle from the Q to the $\overline{Q}$ position causing the $\overline{Q}$ output to go "low" and the Q output to go "high". The "low" at the $\overline{Q}$ output is applied to both terminal 126 of fade timer circuit 10'' and to the one shot pulse generator 132. The "low" applied to the one shot pulse generator 132 will cause a positive spike to be applied to the clock input 172 of memory latch 126. This will cause memory latch 126 to latch into a position wherein its output terminal 178 is "low" and its remaining output terminals are "high". The outputs of memory latch 126 will remain in this position until a new clock signal is applied to its clock input terminal 178. The "low" at output terminal 178 enables analog switch 148 to pass the $E_{y\phi}$ output voltage generated at output terminal 82' of voltage to pulse width converter 62' to potentiometer 116. As noted above, $E_{y\phi}$ will initially be at zero volts D.C. and potentiometer 116 will have no control over the intensity of the lights controlled by circuit 102. However, at the same time that the "low" at the $\overline{Q}$ output of T flip-flop 136 is applied to one shot pulse generator 132, it is also applied to the down input terminal 126 of fade timer circuit 10' causing the output voltage $E_o$ of fade timer 10'' to decrease from a maximum value $E_{null} = E_{ref}$ ($R_f$/2R) to a minimum value of zero volts D.C. This will cause the output voltages $E_{y\phi}$ and $E_{x\phi}$ at output terminals 82' and 84' of the voltage to pulse width converter 62' to vary in the manner described above. As such, control over the intensity of the lights controlled by circuit 102 will fade from potentiometer 118 (which is supplied by the voltage $E_{x\phi}$ ) to potentiometer 116 (which is supplied by the voltage $E_{y\phi}$ ). More particularly, the intensity of the lights controlled by circuit 102 will fade from the present level determined by potentiometer 118 to the preset level determined by potentiometer 118 in a time T controlled by potentiometer 16'' of fade timer circuit 10''.

The manner in which circuit 102 will switch control over the intensity of the lights controlled by circuit 102 from potentiometer 116 to any of the other three potentiometers 114, 116 and 120, should be obvious to those skilled in the art and need not be described in detail at this time. The manner in which circuit 102 will decrease the intensity of the lights controlled thereby from any pre-existing value to blackout, however, deserves further explanation. When it is desired to decrease the intensity of the lights from any pre-existing level to blackout, pushbutton switch 112 is depressed. When pushbutton switch 112 is depressed, a momentary "low" will be applied to AND gate 128 causing a momentary "low" to appear at the output of AND gate 128. The momentary "low" at the output of AND gate 128 is applied to the input of one shot pulse generator 130 causing one shot pulse generator 130 to apply a positive spike to the T input of T flip-flop 136. This will cause the output of T flip-flop 136 to flip from the $\overline{Q}$ position to the Q position causing the Q output to go "low" and the $\overline{Q}$ to go "high". The "low" at the Q output is applied to both terminal 124 of fade timer circuit 10'' and to the one shot pulse generator 134. The "low" applied to the one shot pulse generator 134 will cause a positive spike to be applied to the clock input terminal 168 of memory latch 124. Memory latch 124 will therefore latch its four output terminals into a condition of its four input terminals. Since all four input terminals to memory latch 124 are "high", all four output terminals thereof will be "high". As such, none of the four analog switches 138, 140, 142 or 144 will be enabled, and the $E_{x\phi}$ voltage will not be applied to any of the four potentiometers 114, 116, 118 or 120. The intensity of the lights controlled by circuit 102, however, will initially be at the value dictated by potentiometer 16 since the voltage $E_{y\phi}$ is applied thereto via analog switch 148. However, the "low" applied to one shot pulse generator 134 is also applied to the up input terminal 124 of fade timer circuit 10' causing the output voltage $E_o$ of fade timer circuit 10'' to rise from zero volts D.C. to the maximum value $E_{null} = E_{ref}\,(R_f/2r)$. This will cause output voltage $E_{y\phi}$ to decrease from a steady state value $E_{max}$ to a steady state value of zero volts D.C. in the manner described above (see graph D) thereby decreasing the intensity of the lights controlled by circuit 102 from the value dictated by potentiometer 116 to blackout in a time T controlled by potentiometer 16'' of fade timer circuit 10''.

In review, the third embodiment of the present invention provides means for varying the intensity of a light source between any two of a plurality of preset intensity levels. It should be further recognized by those skilled in the art that the utility of the present embodiment may be enhanced by the utilization of a clock means to selectively generate a "low" at desired inputs to memory latch circuits 124 and 126 at desired time intervals. Such an application would permit the intensity of the light source controlled by circuit 102 to be automatically varied between a plurality of preset levels at predetermined time periods. Such clock means are well known in the art and need not be described herein.

The present invention may be embodied in other specific forms without departing from the spirit or essential attributes thereof, and, accordingly, reference should be made to the appended claims, rather than to the foregoing specification as indicating the scope of the invention.

What is claimed is:

1. Apparatus for generating an output signal for controlling the intensity of a light source, comprising:

means for generating a command signal;

comparator means for comparing said command signal to an output signal and for generating a driving signal representative of said comparison;

integrator means responsive to said driving signal for generating said output signal the absolute value of which increases when the absolute value of said command signal is greater than the absolute value of said output signal, decreases when the absolute value of said command signal is less than the absolute value of said output signal, and remains at a constant value when the absolute value of said command signal is equal to the absolute value of said output signal; and feedback means for applying said output signal to said comparator means.

2. Apparatus in accordance with claim 1, wherein said driving signal generated by said comparator means is at a first discrete level when the absolute value of said command signal is greater than the absolute value of said output signal, a second discrete level when the absolute value of said command signal is less than the absolute value of said output signal, and a third discrete level when the absolute value of said command signal is equal to the absolute value of said output signal.

3. Apparatus in accordance with claim 2, wherein said integrator means integrates said driving signal such that the absolute value of said output signal increases when said driving signal is at said first discrete level, decreases when said driving signal is at said second discrete level and remains at a constant value when said driving signal is at said third discrete level.

4. Apparatus in accordance with claim 1, wherein said means for generating a command signal comprises a means for selectively generating either a first command signal representing a fixed reference signal or a second command signal representing a setable reference signal.

5. Apparatus in accordance with claim 4, wherein said means for selectively generating a command signal further includes means for generating a command signal representing the zero intensity of the light source controlled by said apparatus and wherein said comparator means causes said integrator to generate an output signal which will cause zero intensity of the light source whenever said zero intensity command signal is selected.

6. Apparatus in accordance with claim 1, including means for varying the rate at which said integrator means causes said output signal to increase or decrease.

7. Apparatus for generating an output signal for controlling the intensity of a light source, comprising:

means for generating a command signal;

comparator means for comparing said command signal to an output signal and for generating a first signal when the absolute value of said command signal is greater than the absolute value of said output signal, a second signal when the absolute value of said command signal is less than the absolute value of said output signal and a third signal when the absolute value of said command signal is equal to the absolute value of said output signal; and integrator means responsive to said first, second and third signals for generating said output signal the absolute value of which increases when said comparator means generates said first signal, decreases when said comparator means generates said second signal and remains at a constant value when said comparator means generates said third signal.

8. Apparatus for generating an output signal for controlling the intensity of a light source, comprising:

means for generating a command signal;

means for comparing said command signal to a feedback signal and for generating a difference signal representative of the difference between the absolute value of said command signal and the absolute value of said feedback signal;

null seeking comparator means responsive to said difference signal for generating a first signal when the absolute value of said command signal is greater than the absolute value of said feedback signal, a second signal when the absolute value of said command signal is less than the absolute value of said feedback signal and a third signal when the absolute value of said command signal is equal to the absolute value of said feedback signal;

integrator means responsive to said first, second and third signals for generating an ouput signal the absolute value of which increases when said null seeking comparator means generates said first signal, decreases when said null seeking comparator means generates said second signal and remains at a constant value when said null seeking comparator means generates said third signal; and feedback means responsive to said output signal for generating said feedback signal, said feedback signal being representative of said output signal.

9. Apparatus in accordance with claim 8, wherein said means for generating a command signal comprises a means for selectively generating either a first command signal representing a fixed reference signal or a second command signal representing a setable reference signal.

10. Apparatus in accordance with claim 9, wherein said means for selectively generating a command signal further includes means for generating a command signal representing the zero intensity of the light source controlled by said apparatus and wherein said comparator means causes said integrator means to generate an output signal which will cause zero intensity of the light source whenever said zero intensity command signal is selected.

11. Apparatus in accordance with claim 8, including means for varying the rate at which said integrator means causes said output signal to increase or decrease.

12. Apparatus for controlling the intensity of a light source, comprising:

first ramp generator means for selectively generating a first ramp signal;

second ramp generator means for generating a series of second ramp signals, the frequency of said second ramp signal being greater then the frequency of said first ramp signals;

means for comparing said first and said second ramp signals and for generating a first and a second control signal in response to said comparison, said first control signal having a linearly decreasing pulse width modulated waveform, said second control signal having the complementary waveform of said first control signal such that said second control signal has a linearly increasing pulse width modulated waveform;

first adjustable means for varying the magnitude of said first control signal;

second adjustable means for varying the magnitude of said second control signal;

means for combining said first and said second adjusted control signals so as to generate an output signal for controlling the intensity of a light source.

13. Apparatus in accordance with claim 12, wherein said first ramp generator includes adjustable means for controlling the rate at which, the magnitude of said first ramp generator signal increases or decreases.

14. Apparatus in accordance with claim 12, wherein said comparator means includes:

a first comparator for comparing said first and second ramp signals and for generating said first control signal, said first control signal being at a maximum value when the magnitude of said first ramp signal is greater than the magnitude of said second ramp signal and at a minimum value when the magnitude of said first ramp signal is less than the magnitude of said second ramp signal; and a second comparator for comparing said first and said second ramp signals, and for generating said second output signal, said second output signal being at said minimum value when the magnitude of said first ramp signal is greater than the magnitude of said second ramp signal and at said maximum value when the magnitude of said first ramp signal is less than the magnitude of said second ramp signal.

15. Apparatus in accordance with claim 12, wherein said first and said second adjustable means are slide arm potentiometers.

16. Apparatus in accordance with claim 12, wherein said first ramp generator means comprises:

means for generating a command signal;

comparator means for comparing said command signal and said first ramp signal and for generating a driving signal representative of said comparison; and integrator means responsive to said driving signal for generating said first ramp signal the absolute value of which increases when the absolute value of said command signal is greater than the absolute value of said first ramp signal, decreases when the absolute value of said command signal is less than the absolute value of said first ramp signal, and remains at a constant value when the absolute value of said command signal is equal to the absolute value of said first ramp signal.

17. Apparatus for controlling the intensity of a light switch, comprising:

a plurality of adjustable means for adjusting the magnitude of a control signal applied thereto;

addressing means for generating an addressing signal identifying the adjustable means to which control over the intensity of a light source is to be transferred;

means responsive to said addressing signal for generating a first and a second control signal, said first control signal to decrease from a maximum value to a minimum value in a preselected time interval, said second control signal to increase from a minimum value to a maximum value in a preselected time interval, said means responsive to said addressing signal also for applying said first control signal to said adjustable means at last identified by said addressing means and for applying said second control signal to said adjustable means presently identified by said addressing means; and means for combining the outputs of said plurality of adjustable means such that the combined outputs of said plurality of adjustable means represents an output signal for controlling the intensity of a light source.

18. Apparatus in accordance with claim 17, wherein said means responsive to said addressing signal comprises:

first means responsive to said addressing signal for generating an enabling signal;

second means responsive to said enabling signal for generating said first and said second control signals in response to said enabling signal; and third means for applying said first control signal to said adjustable means last identified by said addressing means and for applying said second control signal to said adjustable means presently identified by said addressing means.

19. Apparatus in accordance with claim 18, wherein said second means includes:

first ramp generator means for selectively generating a first ramp signal;

second ramp generator means for selectively generating a series of second ramp signals; and comparator means for comparing said first and said second ramp signals and for generating said first and said second control signals, said first control signal having a linearly decreasing pulse width modulated waveform, said second control signal having the complementary waveform of said first control signal such that said second control signal is a linearly increasing pulse width modulated waveform.

* * * * *